United States Patent [19]

Silcox

[11] Patent Number: 4,706,722

[45] Date of Patent: Nov. 17, 1987

[54] INCISOR CLEANING SYSTEM

[75] Inventor: Ronald W. Silcox, Langley, Canada

[73] Assignee: B.C. Clean Wood Preservers Ltd., Canada

[21] Appl. No.: 883,174

[22] Filed: Jul. 8, 1986

[51] Int. Cl.[4] ..... B27J 7/00

[52] U.S. Cl. ..... 144/329; 144/2 J; 144/2 K; 144/361; 83/867

[58] Field of Search ..... 83/867, 114; 144/2 J, 144/2 K, 136, 329, 361

[56] References Cited

U.S. PATENT DOCUMENTS

| | | | |
|---|---|---|---|
| 853,714 | 5/1907 | Mitchell . | |
| 1,646,955 | 10/1927 | Edwards et al. . | |
| 1,666,632 | 4/1928 | Stone . | |
| 1,725,176 | 8/1929 | Bevis | 83/114 |
| 2,940,489 | 6/1960 | Feiner | 144/136 |
| 3,125,141 | 3/1964 | Best et al. | 144/2 J |
| 3,650,168 | 3/1972 | Ruschmann | 83/114 |
| 4,137,956 | 2/1979 | Toberg | 144/2 J |

*Primary Examiner*—Donald R. Schran

*Attorney, Agent, or Firm*—Christie, Parker & Hale

[57] ABSTRACT

A lumber incisor comprising a rotatable drum. A plurality of annular incisor rings are mounted on the drum to turn with the drum. Teeth on the periphery of each incisor ring, extend outwardly from a tooth base on the periphery of the incisor rings. An annular spacer ring is positioned between each pair of neighboring incisor rings. An annular cleaning ring surrounds each spacer ring and is freely movable between the neighboring incisor rings. Each of the above annular rings has an inner radius, an outer radius and a ring width equal to the outer radius less the inner radius. The spacer rings have an outer radius less than the outer radius of the incisor rings. The outside diameter of each cleaner ring is at least equal to the incisor ring outside diameter plus a height of one tooth.

10 Claims, 4 Drawing Figures

INCISOR CLEANING SYSTEM

FIELD OF THE INVENTION

This invention relates to a lumber incisor.

DESCRIPTION OF THE PRIOR ART

Incisors of various configurations have been used for many years by the wood preservation industry. The purpose of the incisor is to create punctures or incisions to a depth of about ⅜" through the entire length of a piece of lumber. These incisions facilitate the penetration of preservative into the lumber, affording a much higher degree of preservation.

These incisors are relatively simple in structure. They comprise incisor rings having teeth formed at their periphery. Typically the incisor rings are mounted on a driven roller.

A persistent problem with lumber incisors is the clogging of the incisor teeth when, as is inevitable, large slivers of wood are stripped from the lumber during the incising process. This interrupts the process as it is necessary to clean the incisor teeth. It also can result in an inferior product because the slivers interfere with the penetration of the teeth into the lumber.

The problem is particularly acute with lumber of an impermeable species. Impermeable wood requires a close incision pattern and that, of course, simply aggravates the clogging problem.

Prior art known to applicant comprises the following U.S. Pat. Nos.: 4,137,956 to Toberg; 1,646,955 to Edwards; 853,714 to Mitchell; 3,125,141 to Best; 1,666,632 to Stone; and 2,940,489 to Feiner. However none of the above prior art shows a simple yet persistently effective means of cleaning the slivers of wood from the teeth of lumber incision equipment.

SUMMARY OF THE INVENTION

The present invention provides equipment that is simple to use and yet has provided excellent results in the cleaning of lumber incisors.

The present invention is useful in new equipment or can be added to existing equipment by modification of that equipment.

Accordingly the present invention is a lumber incisor comprising a rotatable drum; a plurality of annular incisor rings mounted on the drum to turn with the drum; teeth on the periphery of each incisor ring, each tooth extending outwardly from a tooth base on the periphery of the incisor rings; an annular spacer ring between each pair of neighbouring incisor rings; an annular cleaning ring surrounding each spacer ring and freely movable between the neighbouring incisor rings; each of the above annular rings having an inner radius, an outer radius and a ring width equal to the outer radius less the inner radius, the spacer rings being of an outer radius less than the outer radius of the incisor rings; the outside diameter of each cleaner ring being at least equal to the incisor ring outside diameter plus a height of one tooth.

DRAWINGS

Aspects of the invention are illustrated, merely by way of example, in the accompanying drawings in which.

DESCRIPTION OF THE PREFERRED EMBODIMENTS

Figure 1:
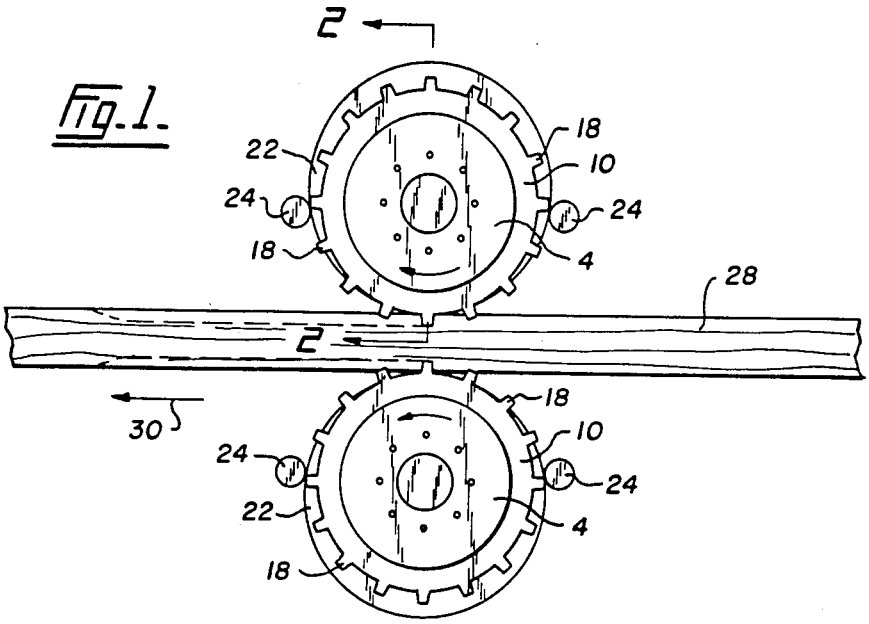
FIG. 1 is a end elevation of a lumber incisor installation according to one aspect of the present invention, preferably for use with rough lumber.

The drawings show a lumber incisor comprising a rotatable drum 2. The drum 2 is received at each end in a housing 4 (only one of which is shown) to which it is secured by bolts 6. A drive shaft 8 extends from the housing 4. The arrangement of the drum 2 in the housing 4 and the arrangement of the drive shaft 8 are conven- tional.

There are a plurality of annular incisor rings 10 mounted on the drum 2 to turn with the drum. As shown particularly in FIGS. 2 and 3 the incisor rings 10 are provided with recesses 12 to receive a key 14. The key 14 also engages the rotatable drum in slot 16. There are teeth 18 on the periphery of each incisor ring 10. Each tooth 18 extends outwardly from a tooth base on the periphery of the incisor ring. There is an annular spacer ring 20 between each pair of neighbouring incisor rings 10. An annular cleaning ring 22 surrounds each spacer ring 20 and is freely movable between neighbouring incisor rings 10.

It should be noted that each of the above annular rings—incisor rings, spacer rings and cleaner rings—has, like any annular ring, and inner radius, an outer radius and a ring width that is equal to the outer radius of the ring less the inner radius of the ring. As is probably most clearly shown in FIG. 2 the spacer rings 20 are of an outer radius substantially less than the outer radius of the incisor rings 10. Furthermore the outside diameter of each cleaner ring 22 must, according to the present invention, be at least equal to the incisor ring outside diameter plus the height of one tooth 18. In the preferred embodiment, for example as shown in FIGS. 1 and 2, the outside diameters of the cleaner rings 22 are substantially greater than the outside diameters of the incisor rings 10.

The teeth 18 on the incisor ring 10 are formed integrally but, for convenience of definition, the incisor ring dimensions are discussed separately in the present specification. That is, the incisor ring is considered to be the annular ring carrying the teeth but not the teeth.

Figure 3:
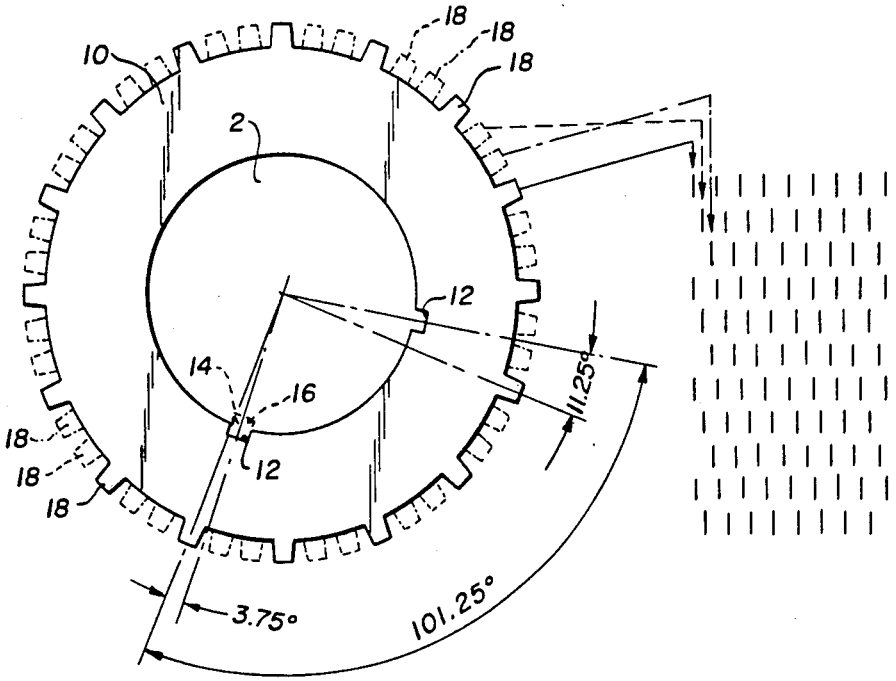
FIG. 3 is a detail illustrating the arrangement of the incisor teeth to produce staggered rows of incision.

FIG. 3 is included to show that by the use of spaced key ways 16 in the drum 2 and incisor rings 10 the teeth 18 can be used to incise a staggered pattern as shown to the right of FIG. 3. The angles given in FIG. 3 are clearly exemplary. The illustrated pattern is known as an offset diamond incising pattern. The teeth 18 on each incisor ring 10 are staggered relative to the teeth 18 on the neighbouring rings 10 resulting in the staggered pattern shown in FIG. 3.

Figure 2:
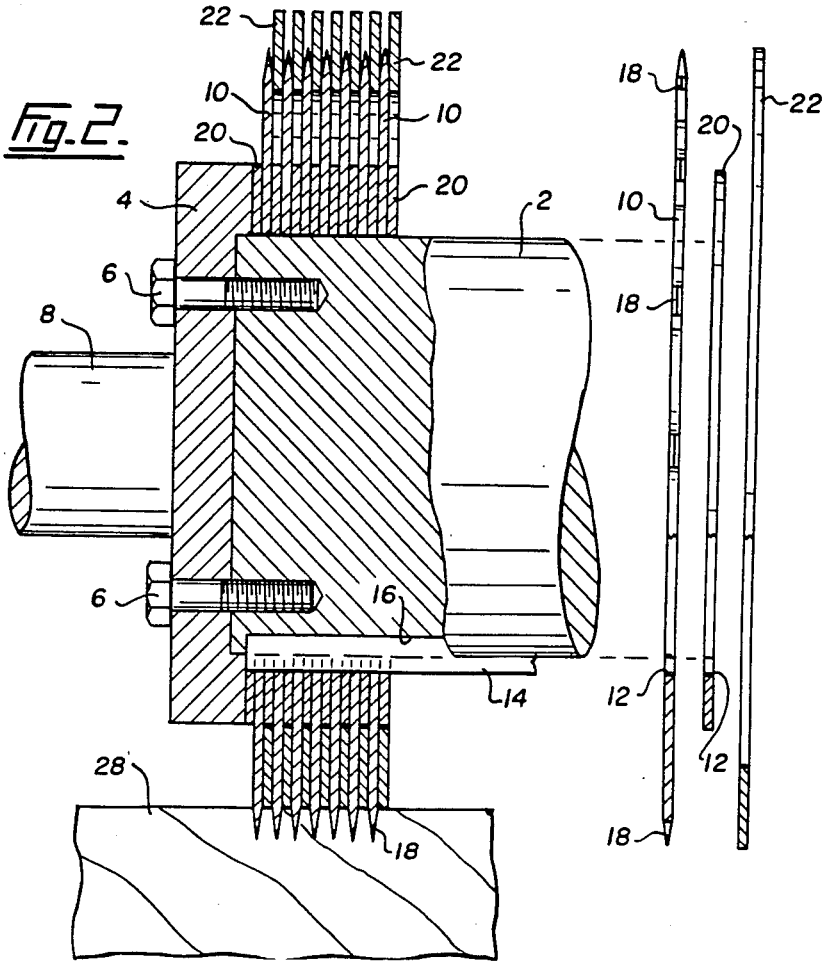
FIG. 2 is a detail, partially in section, on the line 2—2 in FIG. 1.

As indicated, the embodiment of FIGS. 1 and 2 is used with rough lumber. Cleaning rings 22 can be pinched at the edges using rough lumber and can create a plugging problem. To avoid this problem idler rollers 24 are positioned to keep the rings 22 depressed, as shown in FIG. 1.

In a typical lumber incisor installation, as shown in FIG. 1, there will be two incisors as described, spaced from each other to receive a piece of lumber 28 to be incised.

The use of the apparatus of the present invention is conventional. A lumber piece 28 is fed through in the direction of arrow 30, and a pattern of incisions is formed in the lumber by the rotating teeth 18 mounted on the incisor rings 10. An important aspect of the present invention is that as the teeth 18 engage the lumber 28, as shown particularly in FIG. 2, the cleaner rings 22 are forced outwardly, away from lumber 28, so that they project beyond the teeth 18 for a substantial proportion of the periphery of the cleaner rings 22. The effect is to push from the teeth 18 any slivers that are attached to them.

Rolls 24 keep the rings 22 depressed, thus avoiding any plugging problems.

Figure 4:
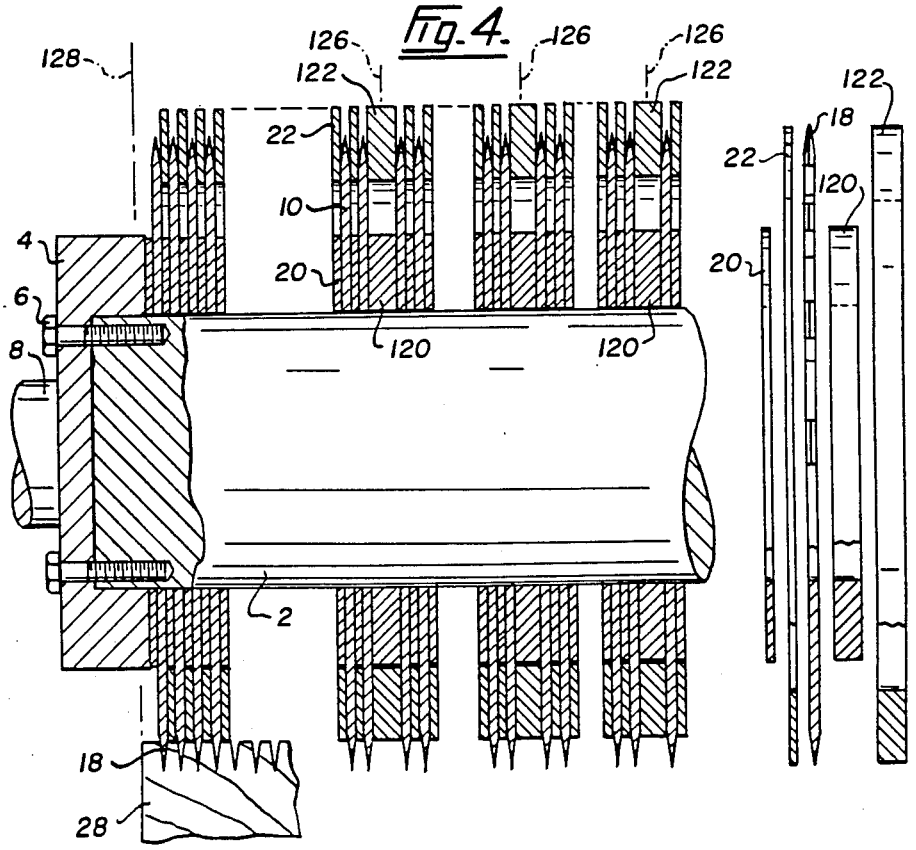
FIG. 4 is a detail similar to FIG. 2 but showing a further embodiment useful with dimensional lumber.

FIG. 4 is a view similar to FIG. 2 showing another embodiment of the present invention.

The embodiment of FIG. 4 shows a different cleaning ring arrangement and is useful with S4S dimensional lumber which, unlike rough lumber, is of precise dimension. The embodiment of FIGS. 1 and 2 is preferably used with rough lumber and that lumber can vary in size by as much as a half-inch. However dimensional lumber is of closely controlled sizes. The embodiment of FIG. 4 closely resembles that of FIGS. 1 and 2 except for the use of intermittent thicker spacer rings 120 and, arranged around the spacer rings 120, are thickened cleaning rings 122. FIG. 4 also demonstrates the use of a reference line, typically defined by edge supports for the lumber, and lines at predetermined distances from the reference line. As is believed clear from FIG. 4 all other aspects of the apparatus are as in FIG. 2. The enlarged cleaner rings 122 are provided to provide an adequate distance between the edge of the dimensional lumber and the first tooth ring to avoid any chipping of the edges which, in dimensional lumber but not in rough lumber, would impair the quality of the lumber. This is particularly so, for example, when the lumber is to be used for decking purposes. The thickened cleaning rings 122, which typically may be of about ⅜" in thickness eliminates potential plugging along the edge of the lumber due to pinching of the conventional sized cleaner rings as discussed above for rough lumber.

The apparatus for FIG. 4 is used precisely the same as in the apparatus of FIG. 2. The centre lines 126 marked are for lumber passing through of predetermined, standard widths. Typically the lines 128 will be 3½", 5½", 7¼", 9¼", 11¼" and so on from the reference line 128. Clearly any dimension can be used but, of course, dimensional lumber is of standard size throughout North America.

The apparatus is extremely simple to use and, indeed, its incising function is no different from the prior art. Its cleaning function is however greatly improved compared with the prior art.

The incisor rings 10, and the teeth 18 formed integrally with them, would typically be of saw steel hardened to 55 to 60 Rockwell hardness. In a typical embodiment the incisor rings will be ground to 0.090" thick. The spacer rings 20 and 120 can be mild steel, no hardening is required. In the embodiments discussed above the spacer rings 20 will be about 0.074" thick, spacer rings 122 will be about 0.010" greater than ⅜".

The cleaner rings 22 again should be of saw steel and, in the above embodiment, are preferably 0.062" thick. The entire ring must be hardened to 50 to 55 Rockwell hardness. Both faces again are surface ground to the desired thickness. The cleaner rings 122 will be about ⅜" thick.

The present invention thus provides a simple but efficient means of cleaning the teeth in a lumber incisor. As indicated above the equipment can be designed from the start to incoporate the cleaner rings but it is also relatively simple to modify existing equipment. The present invention is applicable to both two head and four head incisors.

I claim:

1. A lumber incisor for forming a pattern of incisions in the outer surface of a piece of lumber during an incising operation, the lumber incisor comprising:

a rotatable drum;

a plurality of annular incisor rings mounted on the drum to turn with the drum;

teeth space apart along the periphery of each incisor ring, each tooth extending outwardly from a tooth base on the periphery of the incisor ring;

an annular spacer ring mounted around the drum and between each pair of neighboring incisor rings; and an annular cleaning ring surrounding each spacer ring and freely movable radially outwardly from the drum, between the neighbouring incisor rings;

each of the above annular rings having an inner radius, an outer radius and a ring width equal to the outer radius less the inner radius, the spacer rings having an outer radius less than the outer radius of the incisor rings;

the outside diameter of each cleaning ring being at least equal to the incisor ring outside diameter plus a height of one tooth so that, as the teeth engage the lumber for forming said pattern of incisions in the lumber, the cleaning rings are freely movable to be forced outwardly away from the lumber so they project beyond the teeth for a substantial portion of the periphery of the cleaning rings to push outwardly from the teeth any substances attached to them from the incising operation.

2. A lumber incisor as claimed in claim 1 in which the teeth on the incisor rings are staggered relative to neighbouring rings.

3. A lumber incisor as claimed in claim 1 in which the incisor rings and the spacer rings are located on the drum by keys engaging key-ways in the rings.

4. A lumber incisor as claimed in claim 1 in which the outside diameter of each cleaner ring is greater than the outside diameter of the incisor ring plus the height of one tooth.

5. A lumber incisor as claimed in claim 1 including a guide roller, generally parallel to the drum, to depress the cleaning rings to avoid plugging caused by material lodged between the cleaning ring and the neighbouring incisor rings.

6. A lumber incisor installation comprising two incisors defined in claim 1, spaced from each other to receive a piece of lumber to be incised.

7. An installation as claimed in claim 6 including a guide roller for each lumber incisor.

8. A lumber incisor as claimed in claim 1 in which the outer radius of the spacer rings is less than the inner radius of the cleaning rings for allowing the cleaning rings to freely move radially outwardly.

9. A lumber incisor as claimed in claim 1 in which the annular cleaning rings comprise a flat ring of substantially uniform thickness with an essentially flat non-cutting outer peripheral edge.

10. A method for operating a lumber incisor for forming a pattern of incisions in the outer surface of a piece of lumber during an incising operation and for self-cleaning the lumber incisor, the method comprising:

providing a rotatable drum having a plurality of annular incisor rings mounted on the drum to turn with the drum, with teeth spaced apart along the periphery of each incisor ring, each tooth extending outwardly from a tooth base on the periphery of the incisor ring; and an annular cleaning ring freely movable radially outwardly from the drum between the neighbouring incisor rings, in which the outside diameter of each cleaning ring is at least equal to the incisor ring outside diameter plus the height of one tooth; and forcing the combined annular incisor rings and the cleaning rings into pressure contact with the outer surface of the lumber so that the teeth engage the lumber for forming a pattern of incisions in the lumber, causing the cleaning rings to freely move by being forced outwardly away from the lumber as the teeth engage the lumber so the cleaning rings project beyond the teeth for a sub-stantial portion of the periphery of the cleaning rings to push outwardly from the teeth any substances attached to them from the incising operation.

* * * * *

UNITED STATES PATENT AND TRADEMARK OFFICE

CERTIFICATE OF CORRECTION

PATENT NO. : 4,706,722

DATED : November 17, 1987

INVENTOR(S) : Ronald Wayne Silcox

It is certified that error appears in the above-identified patent and that said Letters Patent is hereby corrected as shown below:

In the Specification:
Column 2, lines 25 and 26, change "conven-tional" to --conventional--; lines 42 and 41, at end of sentence change "ring-s" to --rings--; line 42, change "has" to --have--; line 42, before "inner" change "and" to --an--; line 64, change "key ways" to --keyways--. Column 3, line 39, change "half-inch" to --half inch--; line 39, after "However" add --,--.

In the Claims:
Column 4, line 42, change "neighboring" to --neighbouring--; line 68, change "key-ways" to --keyways--. Column 6, line 22, change "sub-stantial" to --substantial--.

Signed and Sealed this

Nineteenth Day of July, 1988

*Attest:*

DONALD J. QUIGG

*Attesting Officer*

*Commissioner of Patents and Trademarks*